United States Patent [19]

Bostelman

[11] Patent Number: 4,648,365

[45] Date of Patent: Mar. 10, 1987

[54] ENGINE COMPRESSION BRAKING SYSTEM FOR AN INTERNAL COMBUSTION ENGINE

[75] Inventor: Michael A. Bostelman, Columbus, Ind.

[73] Assignee: Cummins Engine Company, Inc., Columbus, Ind.

[21] Appl. No.: 802,045

[22] Filed: Nov. 26, 1985

[51] Int. Cl.[4] ..... F02D 13/04

[52] U.S. Cl. ..... 123/321; 123/90.15; 123/90.46

[58] Field of Search ..... 123/321, 322, 90.12, 123/90.15, 90.45, 90.46, 198 F

[56] References Cited

U.S. PATENT DOCUMENTS

| | | | |
|---|---|---|---|
| 3,405,699 | 10/1968 | Lass . | |
| 3,650,251 | 3/1972 | Pelizzoni | 123/90.57 |
| 4,020,806 | 5/1977 | Aoyama et al. | 123/90.55 |
| 4,164,917 | 8/1979 | Glasson | 123/90.15 |
| 4,384,558 | 5/1983 | Johnson | 123/321 |
| 4,398,510 | 8/1983 | Custer | 123/321 |
| 4,399,787 | 8/1983 | Cavanagh | 123/321 |
| 4,408,580 | 10/1983 | Kosuda et al. | 123/90.16 |
| 4,423,712 | 1/1984 | Mayne et al. | 123/321 |
| 4,475,500 | 10/1984 | Bostelman | 123/321 |

*Primary Examiner*—William A. Cuchlinski, Jr.

*Attorney, Agent, or Firm*—Neuman, Williams, Anderson & Olson

[57] ABSTRACT

An engine compression braking system for an internal combustion engine is provided which utilized a combination of a hydraulic reset mechanism and a lash take-up device. The mechanism and take-up device assure that the engine exhaust valves are closed, or substantially closed, prior to the normal opening of the exhaust valves during the power stroke of the engine drive pistons without adversely affecting the retarding horsepower produced by the engine during a braking mode.

9 Claims, 6 Drawing Figures

ENGINE COMPRESSION BRAKING SYSTEM FOR AN INTERNAL COMBUSTION ENGINE

BACKGROUND OF THE INVENION

Figure 1:
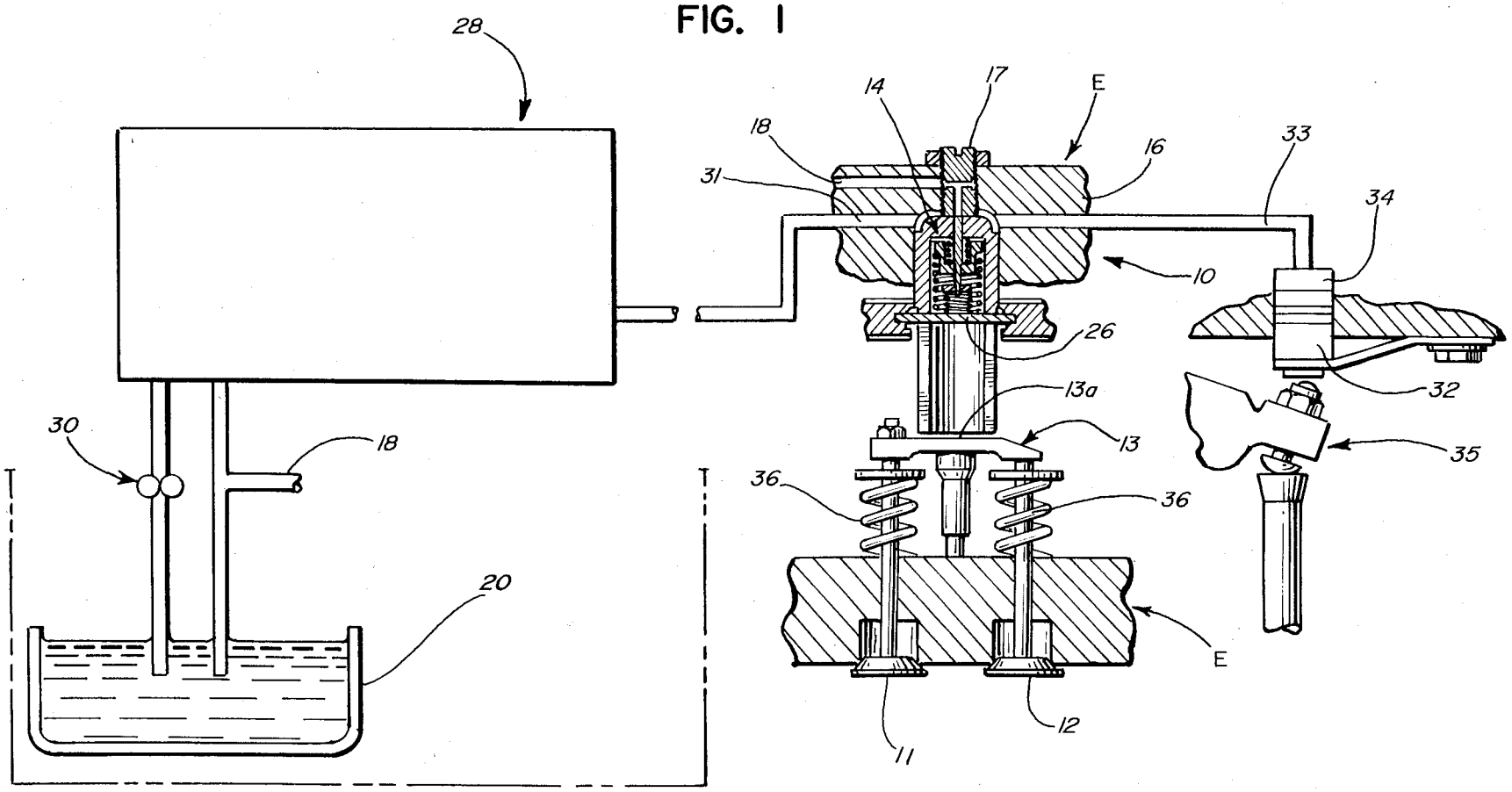

In the operation of various large, over-the-road type vehicles (e.g., semi-trailer trucks), it is oftentimes desirable from a safety standpoint as well as from the standpoint of reducing the initial and maintenance costs of the vehicle braking system that the vehicle engine have the capability of operating in a gas compression braking mode.

Heretofore, in order for the engine to have such a capability required the inclusion of costly and complex controls which were difficult to install, maintain and service. Furthermore, in certain prior slave/master hydraulic braking systems, undesirable delays are encountered in the initiation of the exhaust valve openings during the braking mode operation of the engine. Another disadvantage of these prior slave/master hydraulic braking systems is that significant mechanical loads are imposed on the exhaust valve components when the slave piston is forced by fluid actuating pressure at accelerating speed across the lash distance and impacts the cross-head of the exhaust valve. In many prior reset mechanisms there is no way to vary the timing of the valve opening event because it is determined by the amount of lash that is set when the brake is installed.

SUMMARY OF THE INVENTION

Thus, it is an object of the invention to provide an improved engine compression braking system which overcomes the aforementioned shortcomings associated with prior braking systems of this general type.

It is a further object to provide an improved engine compression braking system which incorporates means for taking up the lash which exists between a slave piston and the cross-head of the exhaust valve and for effecting resetting of the slave piston before the master piston has reached a fully down position.

Further and additional objects will appear from the description, accompanying drawings and appended claims.

In accordance with one embodiment of the invention, an engine compression braking system is provided having an operating means for cyclically opening the exhaust valve in a first predetermined timed relation with the stroke of the power piston when the engine is operating in a power mode. When the engine is operating in a braking mode, a second operating means cyclically opens the exhaust valve in a second predetermined timed relation with the movement of the power piston to effect release of compressed gas pressure from within the engine cylinder and thus prevent the piston from moving through a power stroke. The second operating means includes a hydraulically responsive actuating member, sometimes referred to as the slave piston, which is reciprocally mounted within an auxiliary engine cylinder. The actuating member has a force applying surface which is movable between retracted and fully extended positions relative to a valve opening surface of the second operating means. When the force applying surface assumes a retracted position, it is spaced a predetermined lash distance from the valve opening surface whereby the applying and opening surfaces continually remain in a non-contacting relation when the engine is operating in a power mode. When the force applying surface has moved to a fully extended position during the braking mode of the engine operation, it has moved a distance greater than the predetermined lash distance and displaced the valve opening surface so as to effect opening of the exhaust valve. The auxiliary cylinder is provided with adjustable means which coacts with the actuating member for selectively varying the predetermined lash distance. A source of pressurized hydraulic fluid and a dump port for the hydraulic fluid are provided which communicate with the auxiliary cylinder. The actuating member adjustably carries a valve means which is biased independently thereof into a closing engagement with the dump port when the actuating member is engaging the adjustable means and while said member is traveling the predetermined lash distance away from the adjustable means. The actuating member and the valve means move as a unit, when the actuating member travels a predetermined distance greater than the lash distance thereby resulting in the valve means assuming a non-closing relation with respect to the dump port. Once the dump port is uncovered, the actuating member and the valve means will resume positions wherein the member once again abuttingly engages the adjustable means and the valve means closes the dump port.

DESCRIPTION

For a more complete understanding of the invention reference should be made to the drawings wherein FIG. 1 is a fragmentary, diagrammatic illustration of one embodiment of the improved engine compression braking system for an internal combustion engine. FIGS. 2–6 are enlarged, fragmentary, vertical sectional views of the braking mode operating means showing successive relative positions of the various components thereof during the braking mode operation.

Referring now to the drawings and more particularly to FIG. 1, an improved braking system 10 is shown for an internal combustion engine E having a gas compressing combustion engine piston, not shown, reciprocally mounted within an engine cylinder. Gas is exhausted from the cylinder by the opening of one or more exhaust valves 11, 12. When the engine is operating in its normal power mode, the opening of the exhaust valves is in a first predetermined timed relation with the movement of the piston within the engine cylinder. The opening of the valves 11, 12 is effected by a rocker lever 13 of conventional design. In the power mode of engine operation, the rocker lever 13 is operated through a valve train which includes a rotating cam, not shown, designed to normally leave the exhaust valves closed during the compression and expansion strokes of the engine piston. Thus, during normal operation of the engine in the power mode, the opening of the exhaust valves is under the control of the rotating cam of the valve train.

When, however, the engine is to be operated in a braking mode, the exhaust valves 11, 12 are at least partially opened in accordance with a second predetermined timed sequence as the engine piston nears the end of its compression stroke. To accomplish this result the braking system 10 must over-ride the rotating cam and control the movement of the rocker lever 13 which in turn, controls the opening of the exhaust valves. The system 10 includes an actuating member 14, sometimes referred to as the slave piston, which is reciprocally mounted within an auxiliary cylinder 15 formed in a portion of the cylinder head 16 of the engine E for movement between a retracted position I, see FIG. 2, and a fully extended position II, see FIGS. 5 and 6. The actuating member in the illustrated embodiment has an inverted, substantially cup shape with a closed end 14a thereof facing the closed end 15a of the auxiliary cylinder 15. The opposite or open end 14b of member 14, sometimes referred to hereinafter as the force applying surface, is adjacent a surface 13a of rocker lever 13. When the actuating member 14 is disposed in the retracted position I, surface 14b thereof is spaced from the surface 13a of lever 13 by an amount hereinafter referred to as the lash dimension L, see FIG. 2. The lash dimension compensates for any thermal expansion of the slave piston 14 and/or the rocker lever 13 which might occur during operation of the engine. It is important that the lash dimension be accurately determined so that when the engine is operating in the power mode the member or slave piston 14 will not interfere with the movement of lever 13 by the rotating cam of the valve train.

The lash dimension can be set by an adjusting unit 17 which is threadably mounted in the closed end 15a of cylinder 15. The inner end 17a of unit 17 projects into cylinder 15 and is adapted to be abuttingly engaged by the closed end 14a of actuating member 14 when the latter is in a fully retracted position I. Communicating with the threaded opening 15b in which unit 17 is mounted is a passageway 18 which leads to an oil sump 20, see FIG. 1. Unit 17 is provided with an internal passageway or dump port 17b which is adapted to interconnect passageway 18 with the upper end of cylinder 15. The opening and closing of the internal passageway 17b is controlled by a valve piece 21 which is adjustably carried on the actuating member 14. Piece 21 includes a stem section 21a which is in sliding sealing engagement within a suitable opening 14c formed in the closed end 14a of actuating member 14. The upper end 21b of the stem section is adapted to close-off the end of dump port 17b when the actuating member 14 is in the retracted position I and while the member is moving away from the end 17a of unit 17, a predetermined amount equal substantially to the lash dimension L, see FIG. 3. The opposite end of stem section 21a terminates within the interior of member 14 and has affixed thereto an enlarged stop member 22. Also located within the interior of actuating member 14 and disposed between the stop member 22 and the closed end 14a of member 14 is a lash compensator element 23. The element 23 is substantially cup shape with the open side thereof delimited by an outwardly projecting flange 23a. The flange is adjacent the closed end 14a of the actuating member 14, see FIGS. 2–6. The base section 23b of element 23 is provided with an opening 23c in which is slidably accommodated a segment 21c of the stem section 21a of valve piece 21. The longitudinal dimension of segment 21c is defined by stop member 22 at one end and a shoulder 21d at the opposite end. The shoulder and stop member are impassable with respect to opening 23c.

The actuating member 14 is biased to normally assume the retracted position I, (FIG. 1) by a series of biasing springs 24, 25 working in concert with the lash compensator element 23. Spring 24 is the primary biasing force and is preferably a coil spring which encompasses a substantial portion of the exterior of the lash compensator element 23. The upper end 24a of spring 24 resiliently engages the underside of flange 23a of element 23. The opposite end 24b of spring 24 engages an elongated stationary piece 26 having the opposite laterally extending ends thereof supported within suitable pockets 15b formed in the walls of cylinder 15. A cylindrical skirt portion 14c of actuating member 14 is provided with diametrically opposed, elongated, longitudinally extending slots 14d through which end segments 26a of the stationary piece 26 slidably extend.

Figure 2:
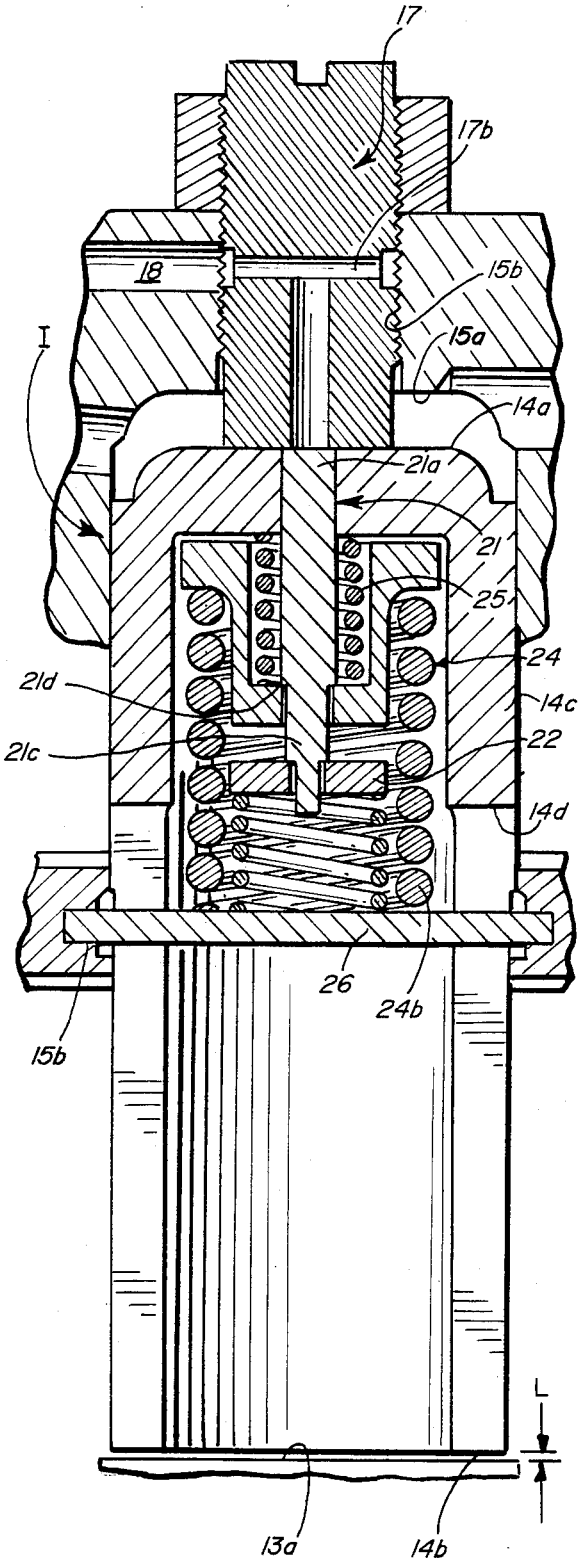
Figure 3:
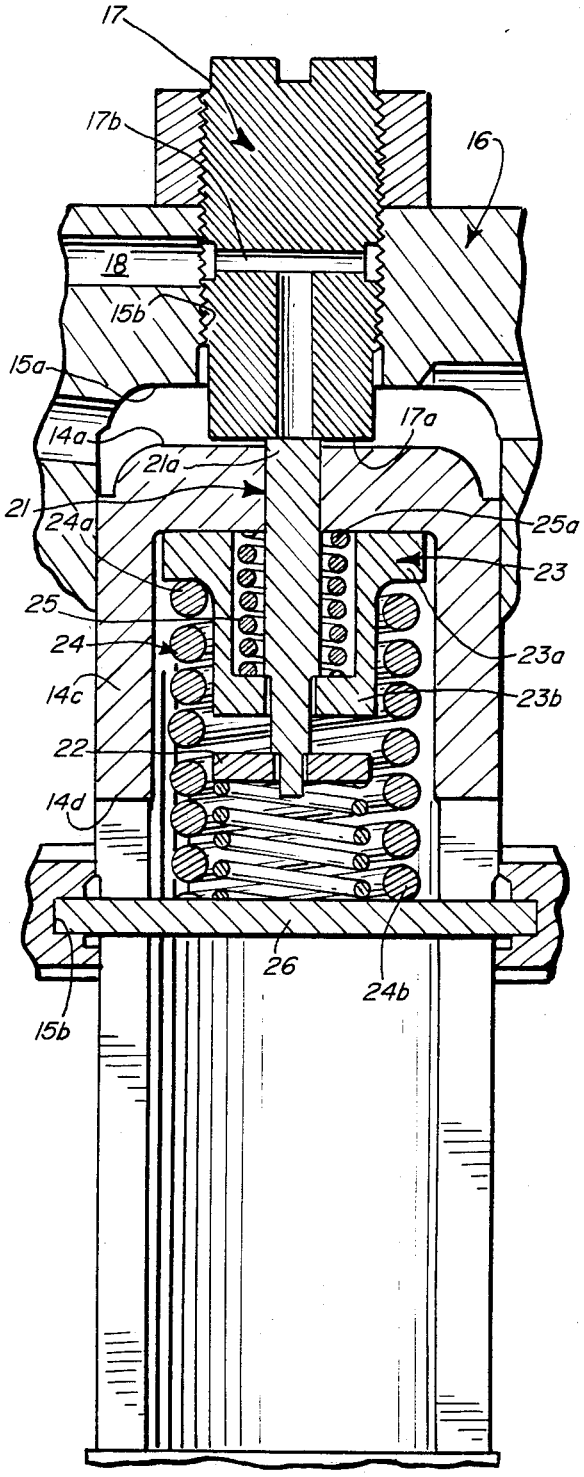
Figure 4:
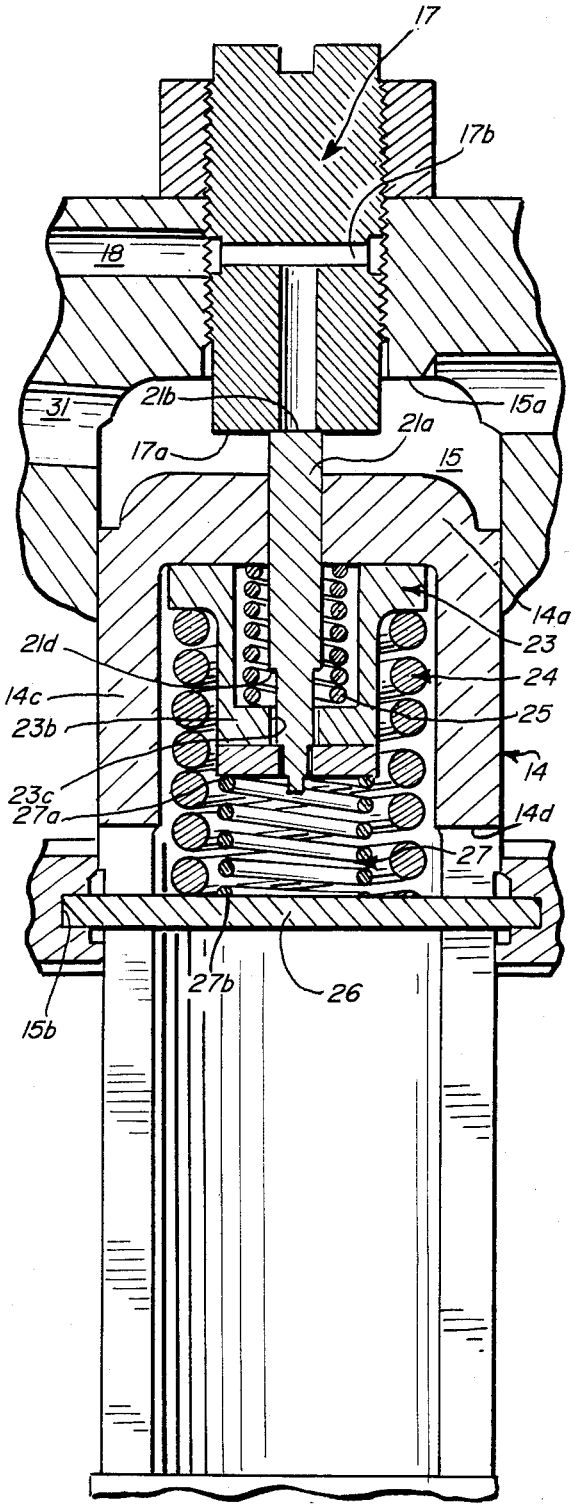
Figure 5:
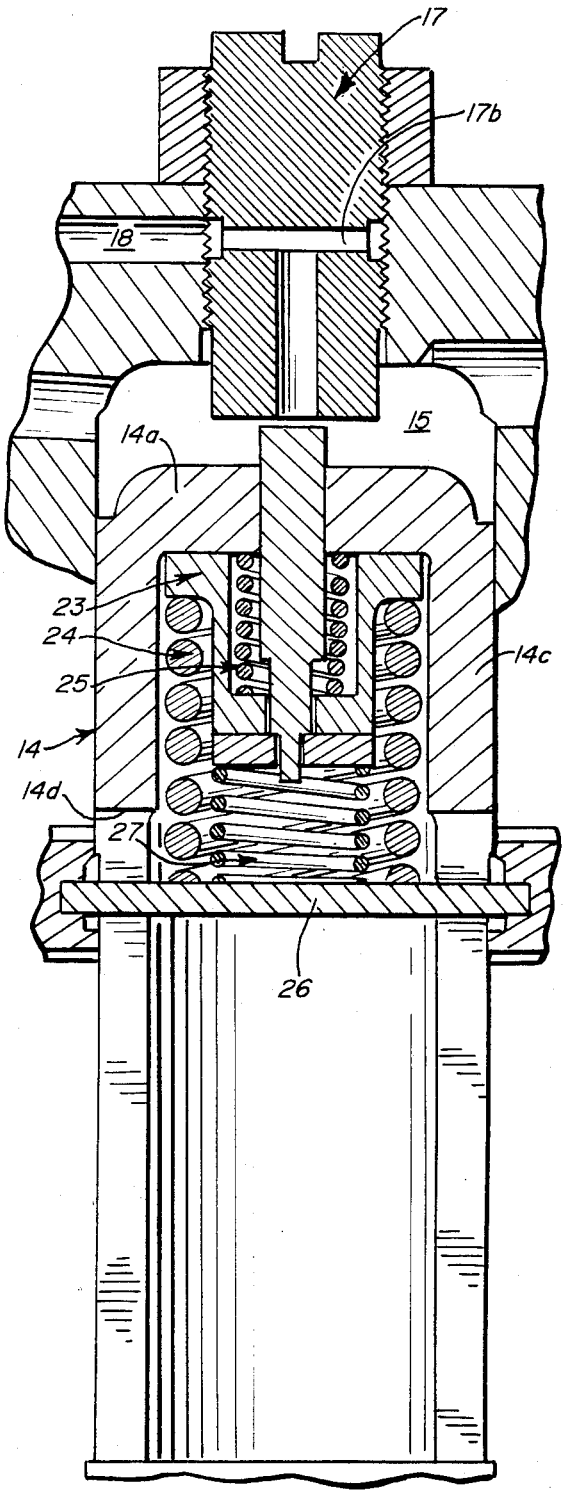
Figure 6:
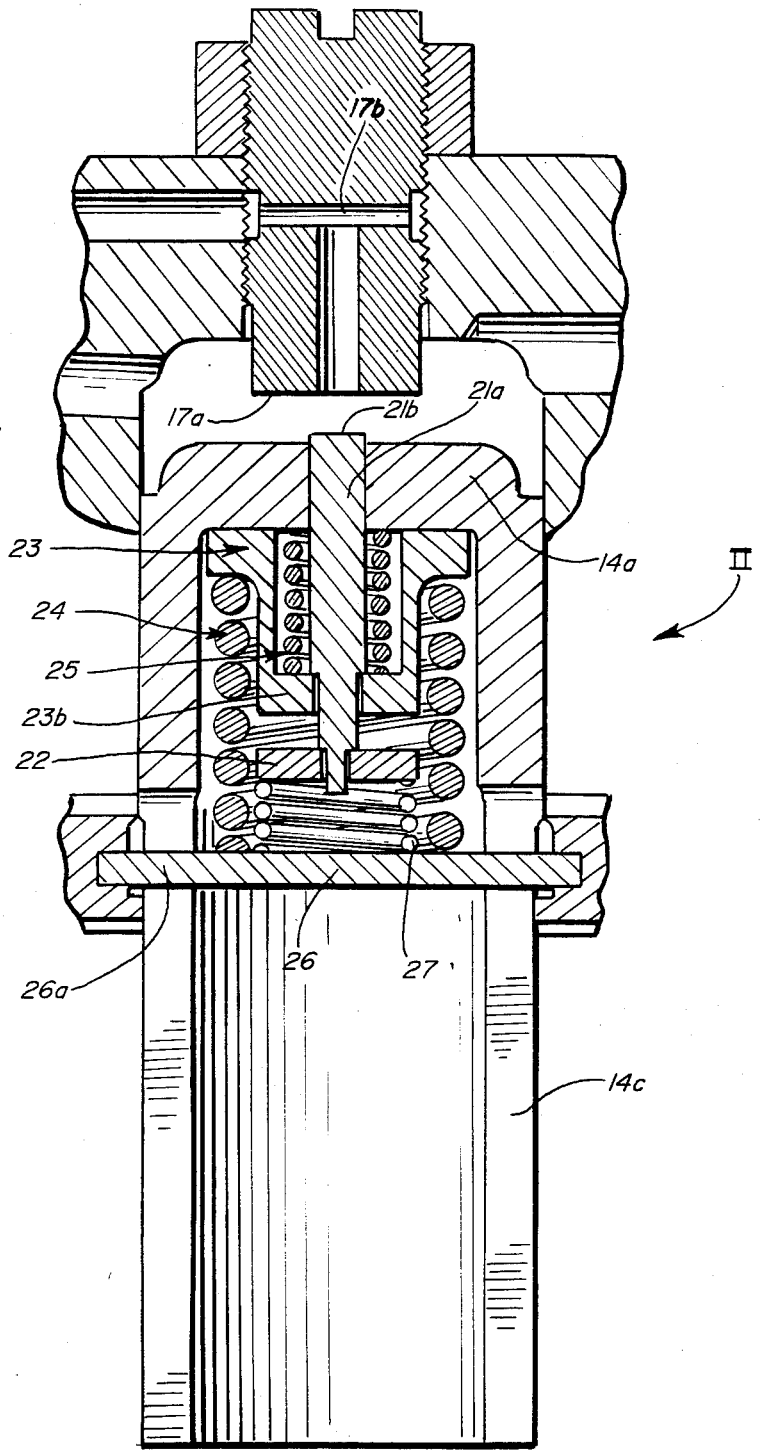

Spring 25 is preferably a coil spring and is dominated by the biasing force of spring 24. As seen in FIG. 2, spring 25 encompasses valve stem section 21a and has one end 25a thereof resiliently engaging the closed end 14a of member 14. The opposite end 25b of spring 25 resiliently engages the base section 23b of lash compensator element 23. Spring 25 biases actuating member 14 upwardly so that the closed end 14a thereof will abut the end 17a of adjustable unit 17 when member 14 is in its fully retracted position I.

A third spring 27 is provided which is surrounded by primary spring 24. One end 27a of spring 27 resiliently engages the underside of stop member 22 and the opposite end 27b engages the stationary piece 26. The function of spring 27 is to cause the upper end 21b of the stem section 21a to remain in a closed relation with dump port 17b as the actuating member 14 moves away from unit 17 a predetermined amount greater than the lash dimension (see FIG. 4). How movement of member 14 away from unit 17 is effected will be described more fully hereinafter.

The hydraulic circuit in which the braking system 10 is incorporated may be similar to that disclosed in my prior U.S. Pat. No. 4,475,500. In order to provide the necessary fluid to the cylinder cavity 15, a fluid control unit 28, shown diagrammatically in FIG. 1, is provided for charging the cavity with fluid at a pressure which is insufficient to cause the actuating member or slave piston 14 to overcome the biasing forces exerted thereon and move to a braking position, that is to say, to assume mode II. Unit 28 is connected at one side to a fluid pump 30 having an intake side thereof connected to the oil sump 20. Unit 28 may incorporate a conventional solenoid three-way control valve, not shown, which is connected to the discharge side of pump 30, when in one position of adjustment, and directs the fluid to an inlet passageway 31 formed in cylinder head 16 and communicating with the upper end of cylinder cavity 15, see FIG. 2. Passageway 31 is in communication with a check valve not shown which allows fluid flow in only one direction through the passageway. When the control valve is in a second position of adjustment, the fluid discharge from pump 30 is diverted back to the sump 20 while the oil pressure within the cylinder cavity 15 remains constant but not sufficient to displace actuating member 14 from its fully retracted position I. When the control valve of unit 28 assumes a third position of adjustment the fluid discharged from pump 30 is diverted to the sump 20 and simultaneously therewith the fluid within the cylinder cavity 15 is also diverted to the sump 20 through passageway 18 thereby removing all fluid pressure from the system and allowing actuating member 14 to assume its fully retracted position I, see FIG. 2. Adjustment of the three-way control valve may be effected by manual manipulation of various controls located within the tractor cab of the vehicle in which the braking system is installed.

It will be noted in FIG. 1 that the upper portion of the cylinder cavity 15 is connected to a master piston 32 by suitable piping 33. One end of piping 33 communicates directly with cylinder cavity 15 and the other end communicates directly with one end of a master cylinder 34 in which the master piston is reciprocally mounted. The master piston 32 is biased to assume a down position relative to cylinder 34, as seen in Fig. 1. To effect the desired cyclic operation of the exhaust valves during the braking mode of operation, the master piston 32 is responsive to the upward movement of a fuel injector actuating train 35, only a portion of which is shown in FIG. 1. When this occurs, piston 32 moves upwardly in cylinder 34 causing the noncompressible fluid within the upper end portion of master cylinder 34, piping 33 and the upper portion of cylinder cavity 15 to be placed under very high pressure causing the actuating member 14 to move downwardly within cylinder 15 and cause the rocker lever 13 to be actuated and open the exhaust valves 11, 12. Thus, the master piston and master cylinder coact to function as a pressurizing means for cyclically increasing the hydraulic or fluid pressure within the slave cylinder cavity 15 so as to overcome periodically the biasing forces of springs 24, 25 and 27 on the slave piston 14 and the biasing force of conventional exhaust valve springs 36.

Thus, it will be seen that an engine compression braking system has been disclosed which enables the lash dimension to be readily adjusted without dismantling the engine and yet enables the actuating member to readily reset without adversely affecting the retarding horsepower produced by the engine during the braking mode.

I claim:

1. A braking system for an internal combustion engine having a gas compressing power piston reciprocally mounted in an engine cylinder having an exhaust valve in communication therewith, comprising (a) power mode operating means for cyclically opening the exhaust valve in a first predetermined timed relation with a power stroke of said power piston when said engine is operating in a power mode, said operating means having a valve opening surface displaceable upon the application of a predetermined force to open the exhaust valve; and (b) a braking mode operating means for cyclically opening the exhaust valve in a second predetermined timed relation with the movement of said power piston to effect operation of the engine in a braking mode by cyclically displacing said valve opening surface to release compressed gas pressure from within the engine cylinder in a selected time sequence with the power stroke of said power piston, said braking mode operating means including (i) a hydraulically responsive actuating member reciprocally mounted within an auxiliary engine cylinder, said actuating member having a force applying surface movable between retracted and fully extended positions relative to said valve opening surface; when in said retracted position, said force applying surface being spaced a predetermined lash distance from said valve opening surface whereby said surfaces continually remain in non-contacting relation when the engine is operating in a power mode; when in a fully extended position, said force applying surface having moved a distance greater than said predetermined lash distance and displacing said valve opening surface to effect opening of said exhaust valve during said braking mode of engine operation;

(ii) adjustable means mounted on said auxiliary engine cylinder and coacting with said actuating member for selectively varying the predetermined lash distance, said actuating member being biased into engagement with said adjustable means;

(iii) a source of pressurized hydraulic fluid communicating with said auxiliary cylinder;

(iv) a dump port for hydraulic fluid communicating with said auxiliary cylinder;

(v) valve means adjustably carried on said actuating member and being biased independently thereof into closing engagement with said dump port when said actuating member is engaging said adjustable means and while traveling said predetermined lash distance away from said adjustable means; said valve means moving as a unit with said actuating member and opening said dump port when said actuating member has traveled from said adjustable means more than said predetermined lash distance whereby said actuating member and said valve means automatically resume positions wherein said member abuttingly engages the adjustable means and the valve means closes the dump port.

2. The braking system of claim 1 wherein said dump port is formed in said adjustable means.

3. The braking system of claim 1 wherein said valve means includes a lash compensator adjustably mounted on said actuating member, a primary biasing means coacting with said lash compensator to dispose the latter at a predetermined distance from said valve opening surface, a secondary biasing means coacting with said actuating member and said lash compensator to cause said force applying surface of said actuating member to normally assume said predetermined lash distance from said valve opening surface, and an elongated valve piece operatively connected to said lash compensator and projecting therefrom and slidably and sealingly extending through an opening in said actuating member whereby a distal end of said valve piece is biased by said primary biasing means into a closed position with said dump port when said actuating member is engaging said adjustable means and while said actuating means has not moved away therefrom more than said predetermined lash distance; the biasing effect of said secondary biasing means being overcome by the force of said pressurized hydraulic fluid when exerted on said actuating member; the force of said pressurized hydraulic fluid being insufficient to overcome the bias of said primary biasing means without said force being enhanced by an additional force of predetermined magnitude.

4. The braking system of claim 3 wherein the actuating member is an inverted cup-shape piston and the lash compensator is disposed within said actuating member; the opening for the elongated valve piece is formed in the closed end of the inverted cup-shape actuating member; the secondary biasing means is disposed between said lash compensator and the closed end of said actuating member, and the primary biasing means is disposed between said lash compensator and a portion of said auxiliary cylinder intermediate said lash compensator and the valve opening surface.

5. The braking system of claim 3 wherein the lash compensator is provided with an opening through which a segment of the elongated valve piece slidably extends, said segment being defined by longitudinally spaced abutting means and having a predetermined longitudinal dimension corresponding substantially to the distance the actuating member travels away from the adjustable means before said valve piece effects opening of said dump port.

6. The braking system of claim 5 wherein the abutting means defining the segment of said valve piece includes a shoulder at one end and a stop member at the opposite end, both said shoulder and stop member being impassable relative to the lash compensator opening.

7. The braking system of claim 6 wherein the stop member is engaged by a third biasing means urging the valve piece towards the adjustable means independently of the actuating member.

8. The braking system of claim 7 wherein the lash compensator abuttingly engages the shoulder of said valve piece when said actuating member is in abutting engagement with said adjustable means.

9. The braking system of claim 7 wherein the third biasing means retains said valve piece in closing relation with said dump port while the actuating member travels away from the adjustable means a distance corresponding substantially to the longitudinal dimension of the valve piece segment.

* * * * *